US008216094B2

(12) United States Patent
Seme

(10) Patent No.: US 8,216,094 B2
(45) Date of Patent: Jul. 10, 2012

(54) BARRIER BALL GAME

(76) Inventor: David J. Seme, Freehold, NJ (US)

( * ) Notice: Subject to any disclaimer, the term of this patent is extended or adjusted under 35 U.S.C. 154(b) by 0 days.

(21) Appl. No.: 12/930,029

(22) Filed: Dec. 27, 2010

(65) Prior Publication Data

US 2011/0172037 A1 Jul. 14, 2011

Related U.S. Application Data

(60) Provisional application No. 61/335,886, filed on Jan. 14, 2010.

(51) Int. Cl.
*A63B 67/04* (2006.01)

(52) U.S. Cl. ..... 473/496; 473/494; 473/490

(58) Field of Classification Search ..... 473/473–475, 473/496, 569, 613
See application file for complete search history.

(56) References Cited

U.S. PATENT DOCUMENTS

| | | | | | |
|---|---|---|---|---|---|
| 2,313,701 | A | * | 3/1943 | White | 473/475 |
| 2,688,484 | A | * | 9/1954 | Garber | 273/317 |
| 3,671,040 | A | * | 6/1972 | Meyer et al. | 473/473 |
| 3,738,653 | A | * | 6/1973 | Simpson | 473/475 |
| 3,891,210 | A | * | 6/1975 | Van Horne | 473/474 |
| 3,908,994 | A | * | 9/1975 | Astrom | 473/613 |
| 4,030,734 | A | * | 6/1977 | Castellucci | 473/475 |
| 4,034,978 | A | * | 7/1977 | Becker | 473/416 |
| D260,154 | S | * | 8/1981 | Dremel | D21/799.2 |
| 4,772,018 | A | * | 9/1988 | Inniger | 473/475 |
| 4,969,645 | A | * | 11/1990 | Barbador | 473/475 |
| 5,178,385 | A | * | 1/1993 | Barbador | 473/475 |
| 5,460,365 | A | * | 10/1995 | Payne | 473/494 |
| 5,470,057 | A | * | 11/1995 | Bodford, Jr. | 473/416 |
| 5,575,471 | A | * | 11/1996 | Robinson et al. | 473/475 |
| 5,615,890 | A | * | 4/1997 | Blue | 473/469 |
| 5,655,979 | A | * | 8/1997 | Blue | 473/475 |
| D410,266 | S | * | 5/1999 | Beckham et al. | D21/799.2 |
| 6,012,997 | A | * | 1/2000 | Mason | 473/594 |
| 2011/0172037 | A1 | * | 7/2011 | Seme | 473/475 |

FOREIGN PATENT DOCUMENTS

| | | | | |
|---|---|---|---|---|
| DE | 19925153 | A1 | * | 12/2000 |
| GB | 2117650 | A | * | 10/1983 |
| GB | 2187964 | A | * | 9/1987 |

* cited by examiner

*Primary Examiner* — Raleigh W. Chiu
(74) *Attorney, Agent, or Firm* — Clifford G. Frayne

(57) ABSTRACT

The present invention provides for a playing surface which should be substantially rectangular in nature and oriented at the height of a standardized table, the playing surface having an adjustable transverse angular divider or barrier bisecting the playing area and side deflector walls extending upwardly from the lateral sides of the playing surface, the game being played by propelling a perforated hollow ball from one side of the playing surface to the other by means of paddles, the playing surface, transverse barrier, and side walls all being part of the playing surface.

2 Claims, 9 Drawing Sheets

BOTTOM OF PLEXI WALL

BOTTOM OF PLEXI WALL

BOTTOM OF PLEXI WALL

BOTTOM OF PLEXI WALL

BARRIER BALL GAME

RELATED APPLICATIONS

Applicant claims the benefit of provisional application Ser. No. 61/335,886, filed Jan. 14, 2010.

BACKGROUND OF THE INVENTION

1. Field of the Invention

This invention relates to a table game and more specifically, to a table game adapted to be played based upon the rules of table tennis, however combining the effects and variety of other paddle games from platform tennis, squash and racket ball.

2. Description of the Prior Art

There are many sports, both table top and field sports, which incorporate a barrier in the form of a net over which a ball must pass. Such sports include field tennis, platform tennis, and ping pong. Further, there are many sports in which the ball is played against a wall, such as hand ball, racket ball and squash, and the players must anticipate the various angles at which the ball will return from the end wall and side walls.

The present invention incorporates and combines the skills required for table tennis, ping pong and tennis with those required for racket ball, squash, and hand ball, in a table top game. Specifically, this invention relates to a game table having a substantially horizontal extending surface having an adjustably angled barrier extending transversely thereof defining opposing fields of play for simultaneous competition by a plurality of players using a single ball. The game table having opposed upright deflector walls extending lengthwise on opposing sides, the length of the deflector walls substantially equal to the length of the transverse barrier, the ball, being struck by the players with a paddle, the game surface including the substantially horizontally extending surface of the table, the angular adjustable sides of the barrier, and the deflector walls. The plurality of adjustable and fixed rebounding surfaces combined to require the players to use the skills of tennis, ping pong, squash, and racquet ball for the playing of the game.

OBJECTS OF THE INVENTION

An object of the present invention is to provide for a novel table top game which simulates a number of paddle ball games for use in relatively confined quarters, wherein the playing surfaces are maximized, using not only the conventional horizontal playing surface, but also walls and a traversing barrier.

A further object of the present invention is to provide for a novel table top game which will afford the effect of a considerable amount of room available for play, but which nevertheless can be played in a relatively confined space, the ballistic characteristics of the ball in relation to the paddle and the playing surface enabling the novel game to be played either relatively fast or relatively slow.

A still further object of the present invention is to provide for a novel table top game which requires the players to propel the ball by means of paddles across a transverse barrier, which barrier also forms part of the playing surface, together with the table top and the side walls.

A still further object of the present invention is to provide for a novel table top game in which the traversing barrier is angularly adjustable with respect to opposing players thereby affecting the path and the rebound of the playing ball and the difficulty of the game.

A still further object of the present invention is to provide for a novel table top game which is unitary in construction including playing surfaces and leg supports.

A still further object of the present invention is to provide for a novel table top game in which the adjustable traversing barrier and the deflector side walls are adapted for conversion of a standard ping pong table to a barrier ball table of the type described hereafter.

SUMMARY OF THE INVENTION

The present invention provides for a playing surface which should be substantially rectangular in nature and oriented at the height of a standardized table, the playing surface having an adjustable transverse angular divider or barrier bisecting the playing area and side deflector walls extending upwardly from the lateral sides of the playing surface, the game being played by propelling a perforated hollow ball from one side of the playing surface to the other by means of paddles, the playing surface, transverse barrier, and side walls all being part of the playing surface.

BRIEF DESCRIPTION OF THE DRAWINGS

These and other objects of the present invention will become evident particularly when taken in light of the following illustrations wherein.

DETAILED DESCRIPTION OF THE INVENTION

Figure 1:
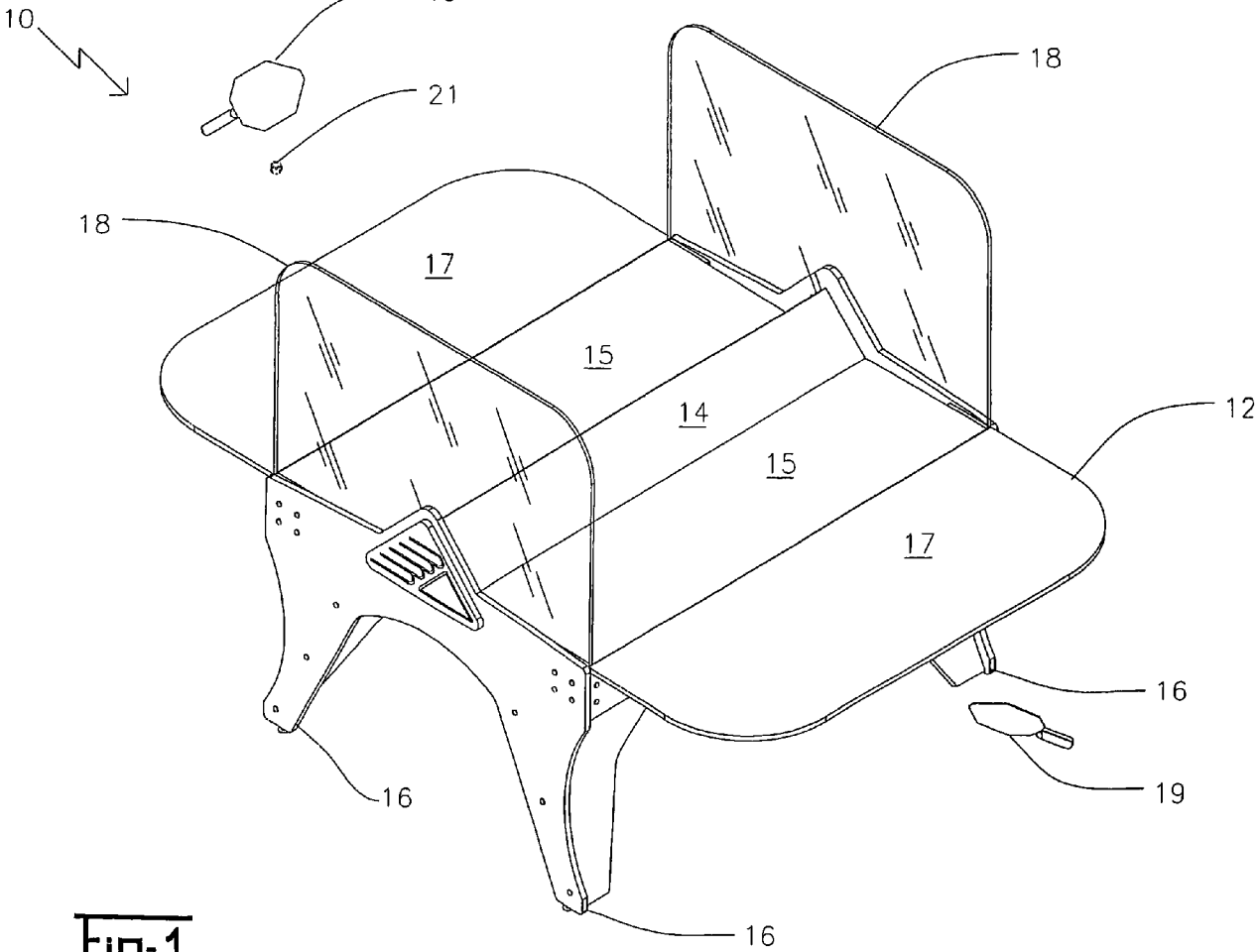
FIG. 1 is an isometric view of one form of a unitary playing table and divider mechanism utilized in conjunction with the barrier ball game, the table illustrated in FIG. 1 being a table specifically dedicated to the barrier ball game.

FIG. 1 is an isometric view illustrating one embodiment of the barrier game. In this embodiment, the game table 10 is a dedicated table to the barrier ball game. It comprises a substantially horizontal playing surface 12 having an adjustable transverse barrier wall 14 extending transversely and bisecting the table top 12 defining opposing fields of play on opposing sides of the barrier wall. The table incorporates support legs 16 which extend above the playing surface, that portion of the support legs extending above the playing surface defining the deflector walls 18 which are part of the playing surface. In the preferred embodiment, the deflector walls 18 would be fabricated from a transparent polymer, such as plexiglass, which would allow spectators viewing the game as it is played to see the action of the ball as explained in more detail hereafter, as it engages the playing surface 12, the barrier wall 14, and the deflector walls 18.

In the preferred embodiment, the table top would be approximately 8 feet long and 5 feet wide, and elevated approximately 2½ from the underlying substrate. The barrier wall members would be angularly adjustable with respect to each other, as more fully described hereafter, so as to allow for greater angular shooting strategy by the players. The height of the deflecting walls with respect to the height of the playing surface would preferably be a height of 2½ feet. The length of the deflecting walls in the preferred embodiment would be 2 feet on either side of the barrier walls so as not to interfere with the swinging of a players arms and paddle 19 when engaging the ball 21.

The unitary dedicated barrier ball table illustrated in FIG. 1 may have application in a recreation center environment, or in a bar or other gaming environment where table games such as pool tables, shuffleboards and the like are often found. It could also be used in a home environment, but its use and convenience may be limited because of the size of the table and its construction. Therefore, a conversion kit of the barrier ball game allows for the conversion of a standard home ping pong table, which is oftentimes foldable in half for storage, to be converted easily and facilely to the barrier ball format. This conversion kit is illustrated in FIGS. 2 through 5.

Figure 2:
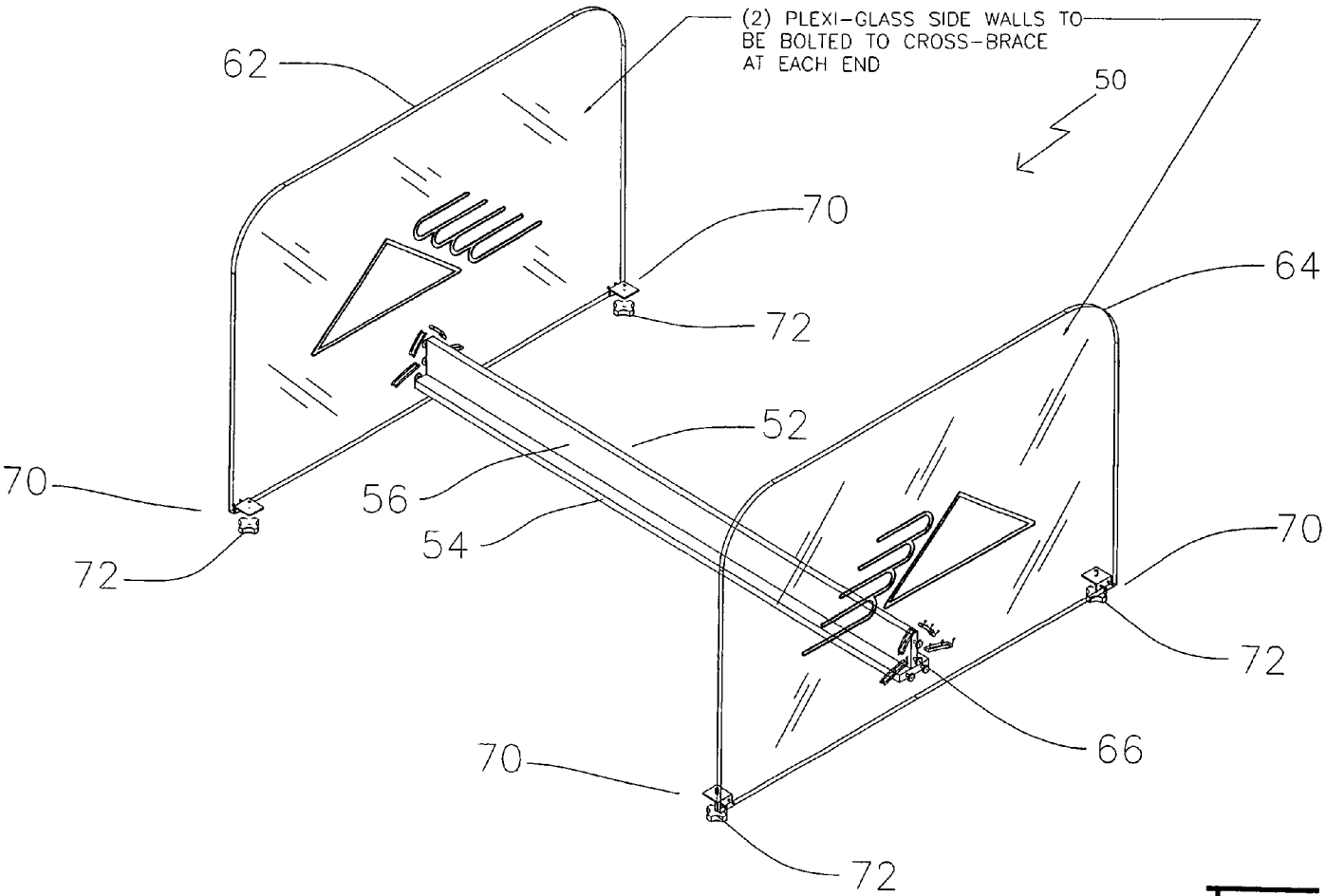
FIG. 2 is an isometric view of a cross-brace assembly and deflector side walls adapted to convert another table top game playing surface such as a ping pong table to barrier ball.

FIG. 2 is an isometric view of a portion of the conversion kit 50 which allows for the conversion of a conventional ping pong table 51 to a barrier ball table. The conversion kit includes a cross-brace 52 which as illustrated in FIG. 2, is in the form of an inverted T having a base member 54 and an upstanding vertical leg member 56. Cross-brace 52 is dimensioned to the width of a standard ping pong table and is designed to traverse the width of the ping pong table at a point where the net would normally be positioned, and bisect the ping pong table playing surface into two opposing surfaces 58 and 60. Deflector walls 62 and 64 are secured to the ends of cross-brace 52 by a plurality of threaded fasteners 66. As in the unitary embodiment illustrated in FIG. 1, the deflector walls 62 and 64 are preferably formed of a transparent polymer.

Deflector walls 62 and 64 have secured in each of their lower corners 70, a thumbscrew bracket 72 which is slidably received on the underside 74 of the ping pong table 51 surface, the thumb screw brackets 72 being tightened to secure the deflector walls 62 and 64 and the attached cross-brace 52 in position on the ping pong table 51.

Figure 3:
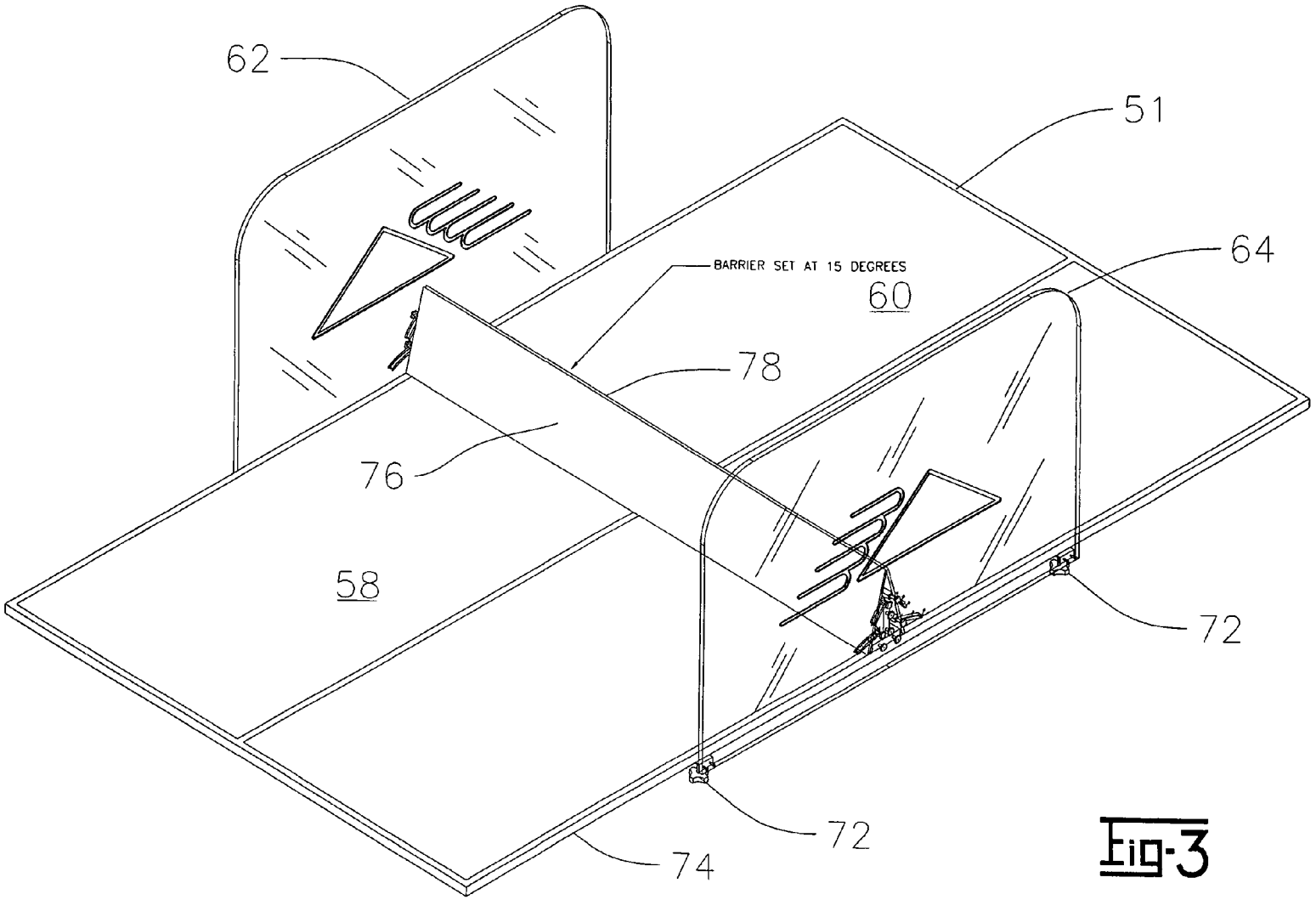
FIG. 3 illustrates the assembly of FIG. 2 incorporating the barrier surfaces set at an angle of 15 degrees secured to a ping pong table top.

FIG. 3 illustrates the assembly of FIG. 2 secured to the playing surface of a ping pong table 51. As illustrated in FIG. 2, the cross-brace 52 is now positioned between and under barrier wall surfaces 76 and 78 which traverse the ping pong table playing surface between opposing deflector walls 62 and 64. The barrier wall surfaces 76 and 78 are angularly adjustable and serve to form a barrier wall 14 identical to that illustrated in FIG. 1 and allows for the players to selectively angularly adjust the barrier walls 76 and 78 to affect the angular motion and momentum of the playing ball 21. In FIG. 3, the barrier walls 76 and 78 are set at an angle of 15 degrees.

Figure 4:
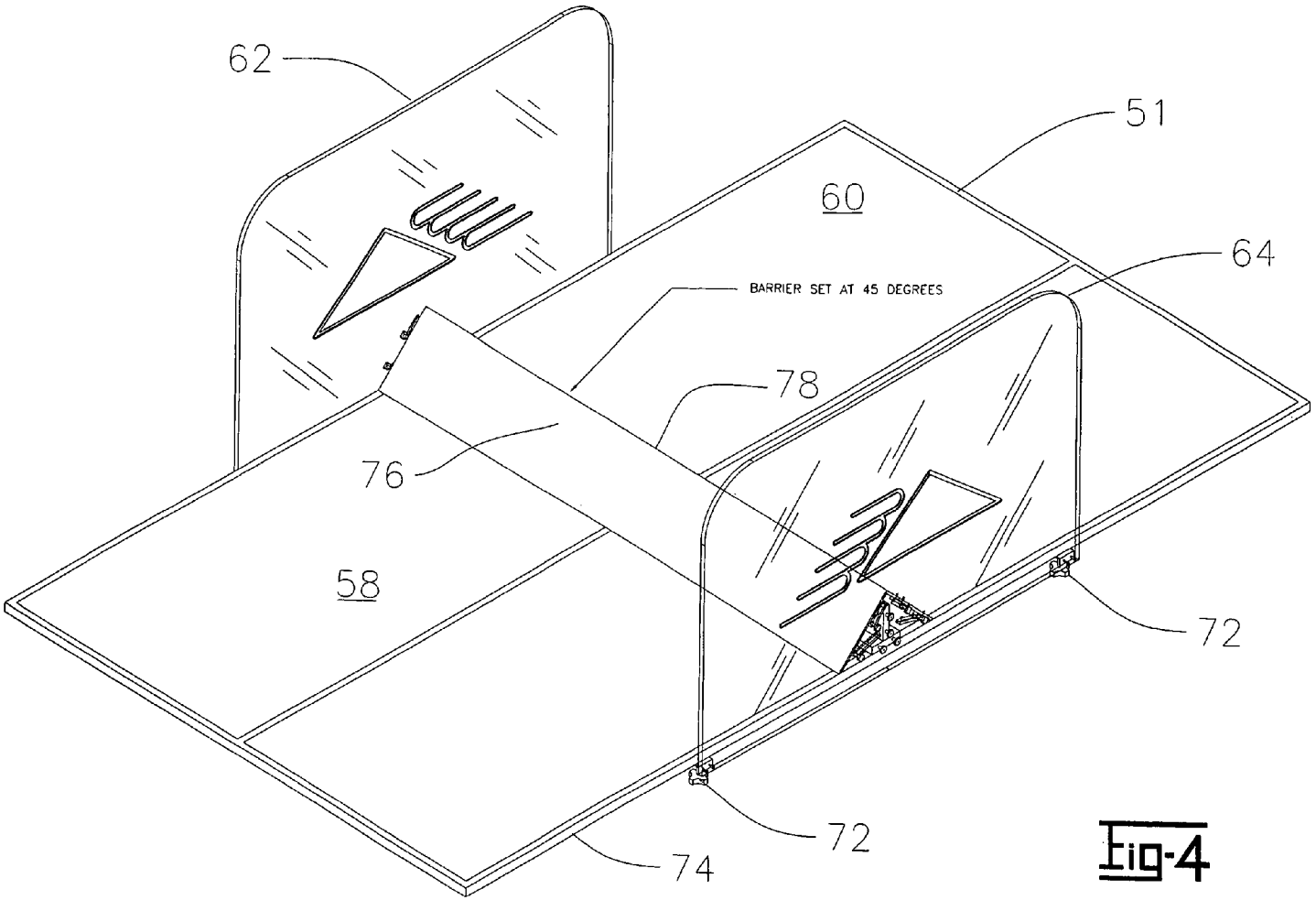
FIG. 4 illustrates the assembly of FIG. 2 with the barrier walls adjusted to a 45 degree angle secured to a ping pong table top.

FIG. 4 illustrates the assembly of FIG. 2 secured to a ping pong table surface, and which in this instance the barrier walls 76 and 78 are selectively angularly adjusted to a 45 degree angle with respect to each other.

Figure 5:
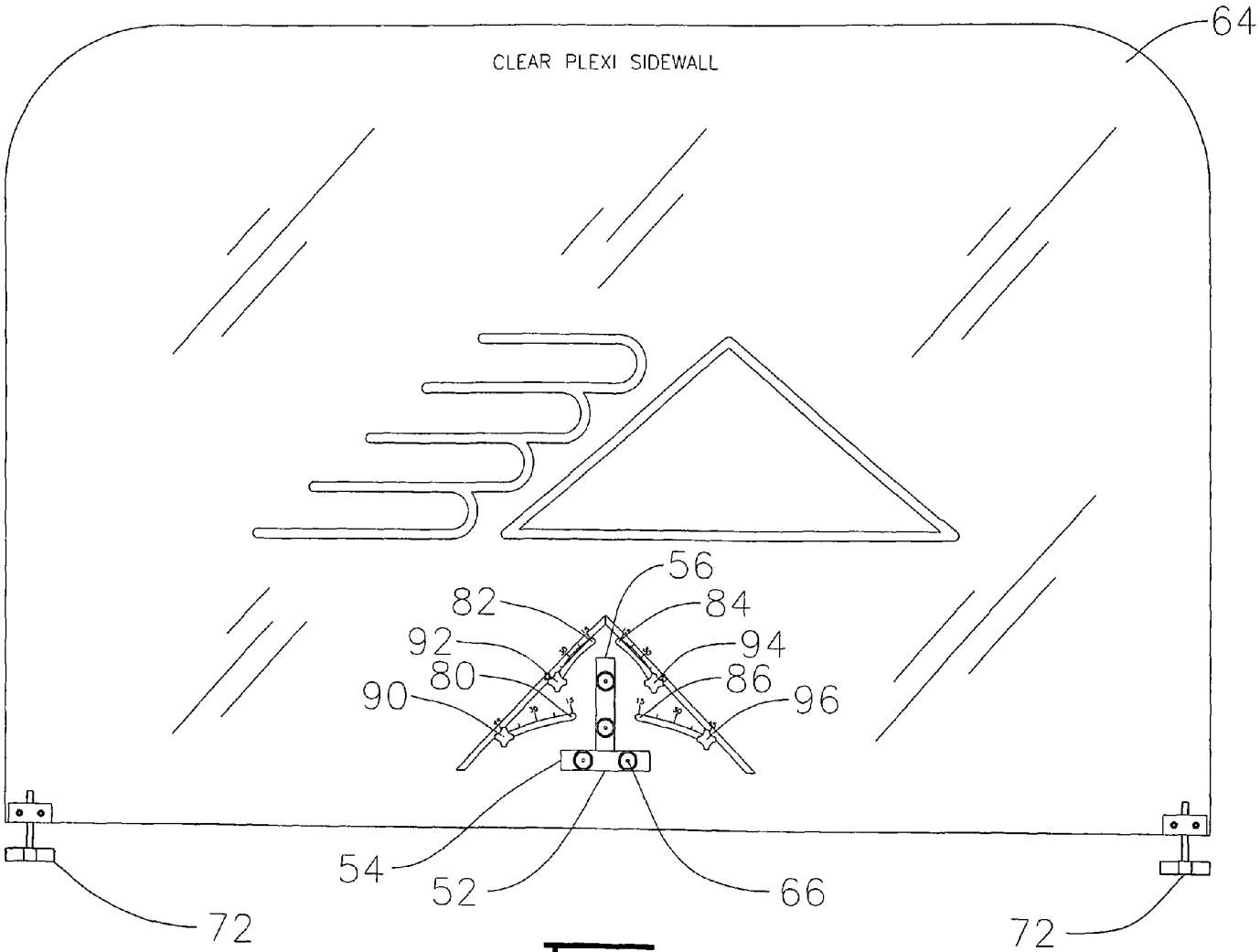
FIG. 5 is a side view of the assembly of FIG. 2 illustrating the cross-brace and deflector wall assembly, together with angle setting protractor guides for adjusting the angle of the barrier walls.

FIG. 5 is an end view of the barrier wall assembly of FIG. 2. In this illustration, the deflector wall, which is fabricated from a clear polymer, such as plexiglass, is secured to the end of cross-brace 52 by a plurality of fasteners 66, such as mounting bolts secured to internally threaded bores in the end of cross-brace 52. The thumb screw brackets 72 at the lower corners of the deflector wall 64 are positioned to engage the underside of the playing surface of the ping pong table 51. There is formed in the deflector wall, a plurality of angular protractor slots 80, 82, 84, and 86 positioned proximate to and on both sides of the end of cross-brace 52. Protractor slots 80, 82, 84, and 86 slidably engage selectively adjustable thumb screws 90, 92, 94, and 96 which selectively pass through their individual slot and are engaged in a threaded bore on the underside of each of the barrier wall members 76 and 78. The slots are further graded with indicia to facilitate angular adjustment. In this manner, the thumb screws 90, 92, 94, and 96 may be loosened, and the barrier wall members 76 and 78 manually adjusted until the thumb screw members are all at the same angular indicia with respect to their respective slots. The thumb screws 90, 92, 94, and 96 would then be tightened to frictionally engage the outer surface of the deflector wall 64 proximate the respective slot to maintain the barrier wall members at the selected degree of angularity for play. The same adjustment would occur on the opposing deflector wall 62 and the same adjustment would be performed on the deflector walls 18 on the permanent embodiment illustrated in FIG. 1.

Figure 6:
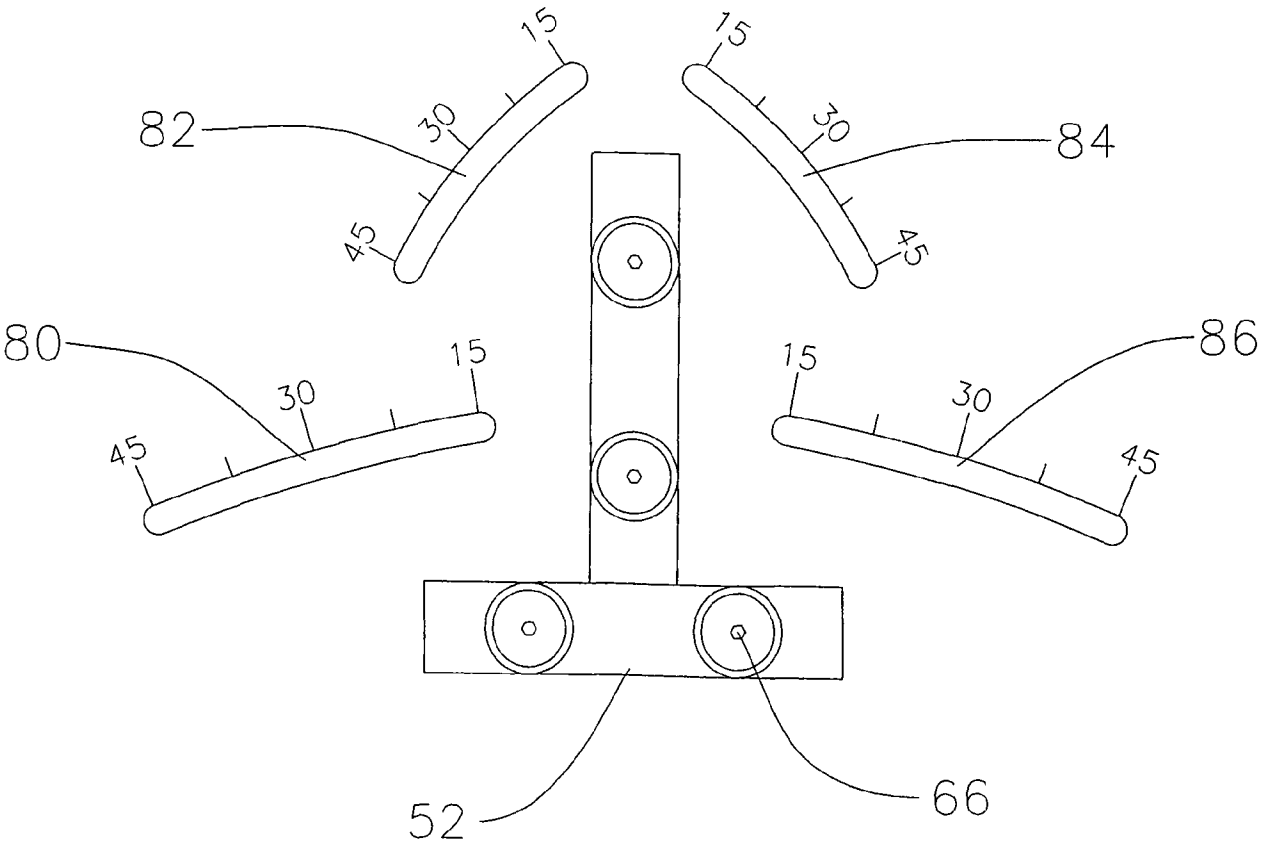
FIGS. 6, 7, 8, and 9 are end views of the cross-brace assembly and protractor guide slots illustrating the manner of adjustment of the angular barrier walls.

FIG. 6 is a side close up view of the end of cross-brace 52 illustrating the positioning of the slots 80, 82, 84, and 86 with respect to the end of cross-brace 52.

Figure 7:
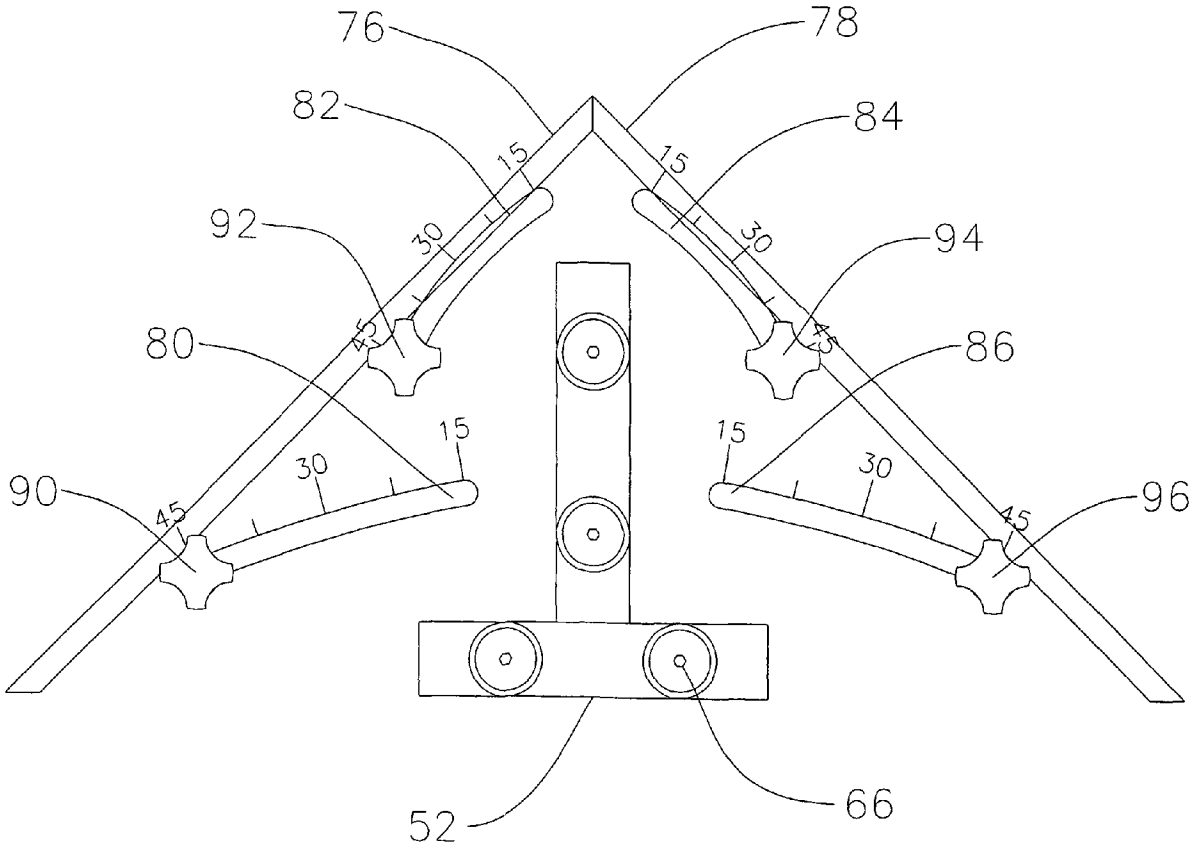
Figure 8:
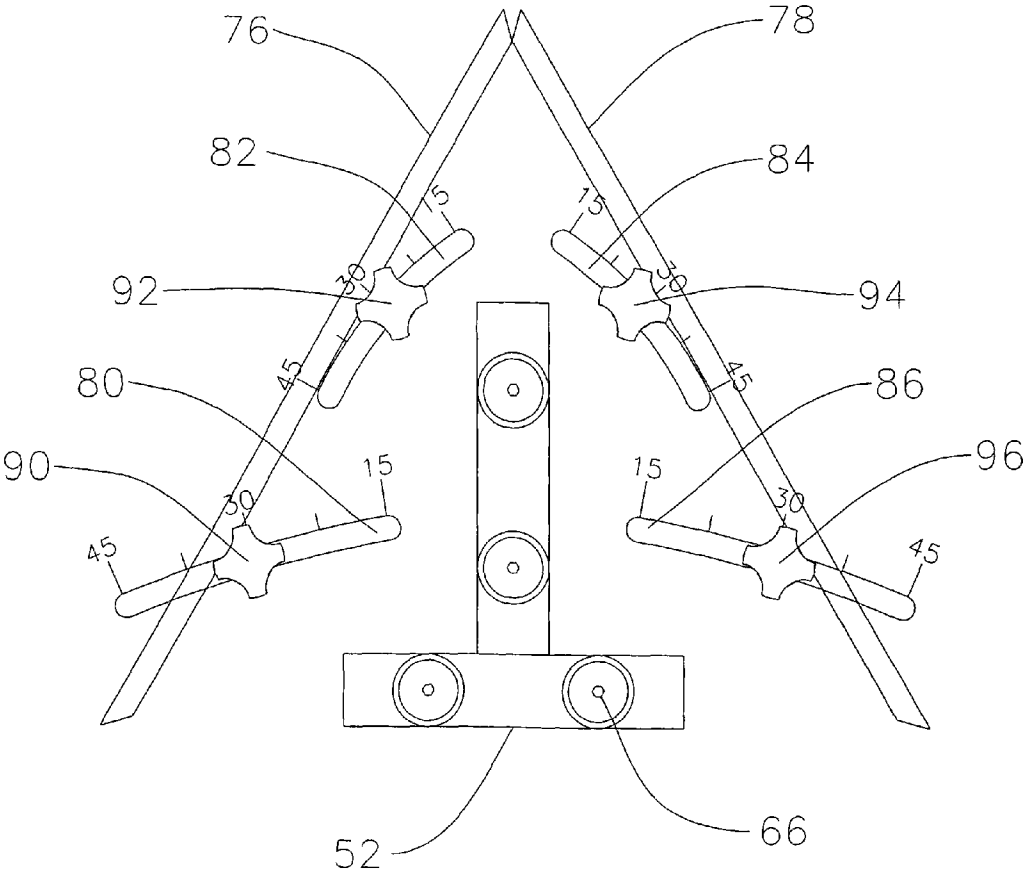
Figure 9:
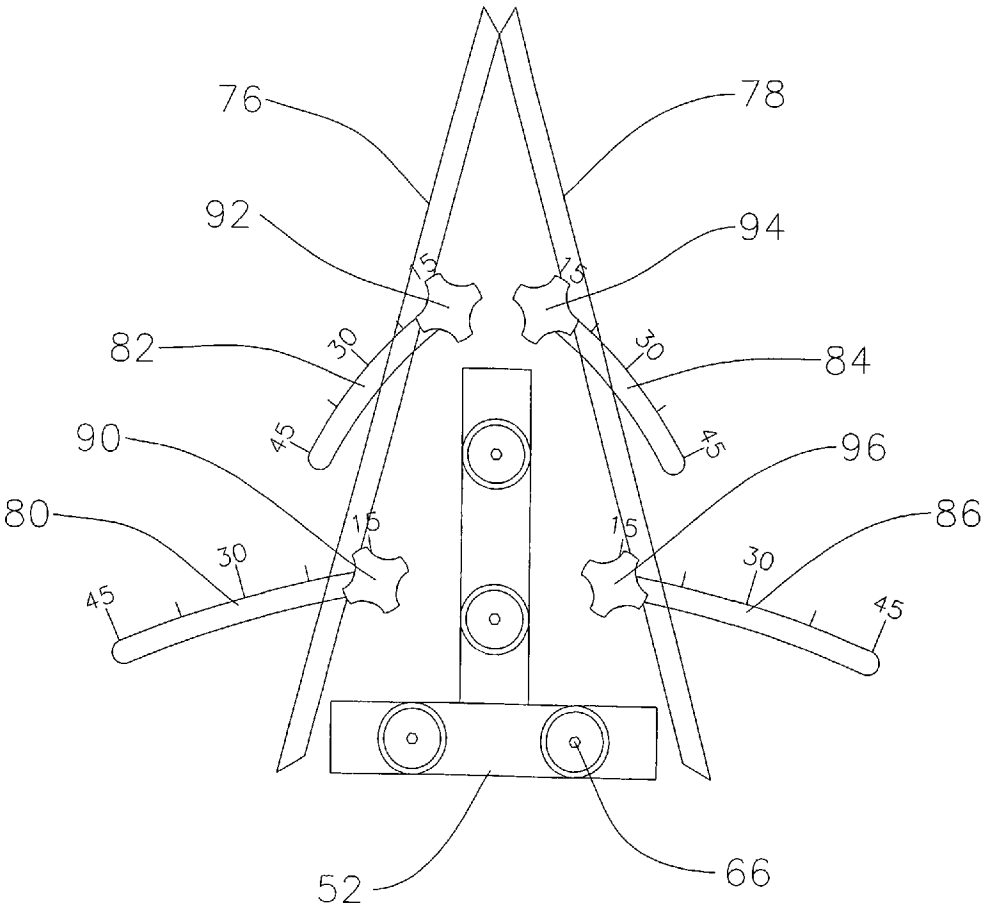

FIGS. 7, 8, and 9 are close up views of the end of the cross-brace 52, slots 80, 82, 84, and 86, barrier wall members 76 and 78, and the thumb screw adjustment members 90, 92, 94, and 96 for positioning the barrier wall members at 45 degree, 30 degree, and 15 degree angularity.

The existence of the barrier wall 14 welcomes the use of a variety of strategies. As a player gets used to the game and improves to the point where he can accurately put the ball 21 where he desires, he can then utilize the barrier wall 14 at will. The barrier wall 14 can be used to set up shots, break an opponent's concentration; or if a player has to reach for a ball 21 that takes him out of position, he can aim for the barrier wall 14 and get back into position and take the second shot.

The forty-five degree angle gives a player the ability to choose the speed and/or height of the return. The deflector walls 18, 62 and 64 also may be used in conjunction with the barrier wall 14.

The skill involved with intentional use of the barrier wall 14 is based on geometrical principles. The barrier wall 14 creates the existence of an infinite amount of possible combinations and angles of return, influencing the speed of the game.

The adjustability of the angles of barrier wall 14 introduces further variables into the game based upon a change in geometrical angles as discussed hereafter. It allows for players having advanced skill in playing the game to introduce an angular modification to the barrier wall 14 which will effect the manner in which the ball 21 reflects from the barrier wall 14 and hence introduce variable strategies into the game.

Referring to FIG. 1, the table surface 12 is divided on each side of the playing table to provide a barrier zone 15 and a service zone 17. The barrier zone 15 is two feet deep from barrier wall 14. The service zone 17, which is part of the playing horizontal surface, extends from barrier zone 15 to the end of the playing surface 12.

The deflecting walls 18 are formed of transparent plastic. The height of the deflecting walls with respect to the plane of the surface of the table top is two and one half feet. The length of the deflecting walls 10 is set to extend the full length of the barrier zone 15. In this embodiment, it is fixed to be four feet. By forming the deflecting walls 10 of a transparent plastic material permits spectators to view the play of the game. It also assists novices to the game in watching skilled players play the game such that the novices can more quickly gain insight into the strategies of play.

The game is played by two players each having a paddle 19 which is designed to allow it to return perforated balls 21 between the barrier zone 15 and deflector walls 18. The paddle 19 has a batting portion on each side and an integral handle portion. The batting portions are each provided with a soft plastic covering for ball control. The paddle 19 is constructed of wood, light metal or celluloid, or any other suitable material having the required lightness and strength to withstand the blows struck against the plastic ball.

In the returning of the ball 21, the player may use the surfaces of the vertical deflector walls 18; the angular barrier wall 14; as playing surfaces as well as the playing surface formed by the table top 12.

The service is developed by the server holding the ball 21 in an outstretched, open palm and either tossing the ball 21 up or just dropping it. The server must then strike the ball 21 before it makes contact with service zone 17 on the playing horizontal surface 12. As the player's paddle 19 makes contact with the ball 21, it must then bounce behind the server's service zone 15. The ball 21 must then cross the barrier wall 14. Deflector walls 18 may be used to allow the ball 21 to bounce within the opponent's service zone 17. Should the ball go beyond the opponent's service zone 17 on the serve, it is considered "long" and the server automatically loses his serve. Should the ball bounce correctly in the server's service zone 17 but totally pass over his opponent's service zone 17, it is also "long" and results in an automatic loss of serve. Should the ball bounce correctly in the server's service zone 17 but fall short of his opponent's service zone 17 it is ruled "short" and the server gets a second serve. If he serves any type of a bad serve on his second serve, he loses his serve and the opponent gets one point automatically. The use of the barrier wall 14 is prohibited during a serve. If the ball 21 makes contact at all with the barrier wall 14 on the serve, it is also ruled "bad" and results in the automatic loss of the serve. An opponent may not under any circumstances (anticipation of long, short or good serve) return a serve on a fly. If this occurs, a point is awarded to the server.

In this invention, the game involves hitting the ball 21 back and forth over the barrier wall 14 until one player misses his opponent's shot; cannot hit his opponent's shot before the ball bounces a second time; or returns his opponent's shot but hits it off the playing surface before it bounces on his opponent's horizontal playing area. A player may return a shot before or after it bounces on his horizontal playing area. Any combination of vertical deflector walls 18, barrier wall 14, or horizontal surfaces 12 may be used. However, the ball 21 may only bounce one time on horizontal surface 12 during a combination. As the player then attempts to return the ball 21 once his paddle 19 makes contact with the ball 21, it cannot bounce on that player's horizontal surface. However, he may use the vertical deflector walls; since they have no center line and their entire area may be utilized by both players either returning or pursuing a shot. Should the ball 21 not clear the barrier wall 14 and bounce back, the player has the opportunity to take one more shot at the ball 21; but only one time while he is in possession of the volley. Should this type of shot occur as the ball 21 bounces back off the barrier wall 14, it is treated as if the opponent returned the shot and the same rules apply. If on the second shot the ball 21 hits the barrier wall 14 but goes over to the opponent's playing area, it s ruled "good".

The playing of the game has been described with respect to FIG. 1 which represents a game table dedicated to the barrier ball game. The same rules would apply to the conversion kit illustrated in FIGS. 2 through 9 which could be utilized to convert a ping pong table to a barrier ball game. Since the barrier zone 15 extends from the barrier wall 14 to a point defined by the ends of the deflector walls 18, (62 and 64 in the conversion kit) the uses of the conversion kit for a ping pong table can readily establish the delineation between the barrier zone 15 and the service zone 17 by means of a tape extending transversely across the table, the terminus of which would be the ends of the deflector walls 62 and 64.

While the present invention has been described with respect to the exemplary embodiments thereof, it will be recognized by those of ordinary skill in the art that many modifications or changes can be achieved without departing from the spirit and scope of the invention. In particularly, it will be recognized that the angular adjustment of the barrier wall members may be mechanical accomplished by means other than described. Therefore it is manifestly intended that the invention be limited only by the scope of the claims and the equivalence thereof.

I claim:

1. An apparatus for playing a table ball game which provides similar physical affects as those experienced by players of a variety of paddle ball games, namely table tennis, platform tennis, squash, and racquetball, said apparatus comprising:

a substantially horizontal playing surface supported by a plurality of legs, said horizontal playing surface having opposing lateral ends and opposing longitudinal sides, said horizontal playing surface of sufficient length to enable two players to stand and play at opposing lateral ends thereof;

an adjustable two piece transverse barrier positioned on said playing surface and bisecting said playing surface in half, and also comprising a portion of said playing surface itself;

a pair of vertical parallel deflector playing surfaces centered on said adjustable two piece transverse barrier and extending upwardly from said horizontal playing surface along the said longitudinal sides of said horizontal playing surface;

a playing ball with fixed means to control its ballistics and velocity;

a paddle means for contact with said playing ball;

said adjustable two piece transverse barrier comprises two planar members selectively angularly adjustable with respect to each other and said horizontal playing surface so as to present two angular playing surfaces for playing and deflecting said playing ball;

said adjustable two piece transverse barrier is angularly adjustable by means of a plurality of exteriorly threaded bolt members positioned and extending outwardly from ends of said two piece transverse barrier and cooperative with and extending through a plurality of arcuate slots formed in said pair of vertical parallel deflector playing surfaces and secured in angular position by a plurality of threaded securing means secured to said extending bolts and frictionally engaging said pair of vertical parallel deflector playing surfaces; and said pair of vertical parallel deflector playing surfaces are secured to a fixed transverse support member secured to said horizontal playing surface beneath and between said adjustable two piece transverse barrier.

2. An apparatus in the form of a conversion kit for converting a table tennis table for playing a table ball game which provides similar physical affects as those experienced by players of a variety of paddle ball games, namely table tennis, platform tennis, squash, and racquetball, said kit comprising:

an adjustable two piece transverse barrier positioned on said playing surface and bisecting said playing surface in half, and also comprising a portion of said playing surface itself;

a pair of vertical parallel deflector playing surfaces centered on said adjustable two piece transverse barrier and extending upwardly from said horizontal playing surface along the said longitudinal sides of said horizontal playing surface;

a playing ball with fixed means to control its ballistics and velocity;

a paddle means for contact with said playing ball;

said adjustable two piece transverse barrier comprises two planar members selectively angularly adjustable with respect to each other and said horizontal playing surface so as to present two angular playing surfaces for playing and deflecting said playing ball;

said adjustable two piece transverse barrier is angularly adjustable by means of a plurality of exteriorly threaded bolt members positioned and extending outwardly from ends of said two piece transverse barrier and cooperative with and extending through a plurality of arcuate slots formed in said pair of vertical parallel deflector playing surfaces and secured in angular position by a plurality of threaded securing means secured to said extending bolts and frictionally engaging said pair of vertical parallel deflector playing surfaces; and said pair of vertical parallel deflector playing surfaces are secured to a transverse support member secured to said horizontal playing surface beneath and between said adjustable two piece transverse barrier;

said adjustable two piece transverse barrier and a pair of vertical parallel deflector playing surfaces secured to said table tennis table by means of a plurality of clamps and thumbscrews so as to convert a table tennis table to the play of a game having multiple deflecting surfaces.

* * * * *